United States Patent [19]

Ledet

[11] 4,031,955

[45] June 28, 1977

[54] DOWN HOLE INHIBITOR INJECTOR

[75] Inventor: Charles A. Ledet, Houston, Tex.

[73] Assignee: Baker Oil Tools, Inc., Houston, Tex.

[22] Filed: Jan. 20, 1976

[21] Appl. No.: 650,741

[52] U.S. Cl. ..... 166/183; 166/117.5; 166/188; 166/244 C

[51] Int. Cl.[2] ..... E21B 33/12

[58] Field of Search ..... 166/183, 188, 189, 117.5, 166/244 C, 149; 137/155

[56] References Cited

UNITED STATES PATENTS

| | | | |
|---|---|---|---|
| 258,565 | 5/1882 | Dresser | 166/189 |
| 1,273,663 | 7/1918 | Pierce | 166/189 |
| 2,748,792 | 6/1956 | Davis | 137/155 |
| 2,798,558 | 7/1957 | McCulloch | 166/189 |
| 3,566,970 | 3/1971 | Crow | 166/244 C |
| 3,727,683 | 4/1973 | Terral et al. | 166/117.5 |
| 3,897,822 | 8/1975 | Mott | 166/189 |

*Primary Examiner*—James A. Leppink
*Attorney, Agent, or Firm*—William C. Norvell, Jr.

[57] ABSTRACT

Apparatus is provided for affording transmission of liquid or gas inhibitor within and below the bore of a well packer during production of hydrocarbons in a subterranean well.

14 Claims, 4 Drawing Figures

DOWN HOLE INHIBITOR INJECTOR

BACKGROUND OF THE INVENTION

1. Field of the Invention

The present invention pertains to an apparatus designed for down hold use during the production of hydrocarbons in an oil or gas well wherein means are provided to enable injecting chemical inhibitor against corrosion and the like within the well casing to the area immediate and below the well packer apparatus for subsequent circulation of the inhibitor with the produced hydrocarbon within well tubing inserted through the packer apparatus, to the well surface.

2. Description of the Prior Art

Corrosion of metallic production tubing and the like utilized in oil and gas wells is caused by numerous chemical factors and has been a problem of great concern to the industry. Heretofore, metallic tubing has been protected by circulating within the tubing-casing annulus a chemical corrosion inhibitor, the chemical formulation of which has varied throughout the years with improvements in the art. The utilized inhibitor generally is made up through emulsification with water or diesel oil and is circulated within an aqueous system down the tubing-casing annulus, thence upwardly above the packer in the produced hydrocarbon stream from the production zone of the well. Although advantageous and affording protection above the packing assembly, this concept and procedure has not afforded protection against and inhibition of corrosion of metallic tubing inserted through and projecting immediately below the lower end of the packer assembly. Therefore, this area is exposed to a potential corrosive environment without means of protection therefrom.

The present invention overcomes the problems resulting from use of prior art means for affording protection against corrosion of metallic tubing used during the production of hydrocarbons in an oil and gas well by providing means whereby the fluid inhibitor within the tubing-casing annulus is circulated through a valving apparatus and a circulation bypass for ejection below the lower end of the packer assembly, whereby the corrosion inhibitor solution is mixed with the produced hydrocarbon and circulated to the top of the well through the production tubing, the lower end of which is projected through the packer assembly. By use of the present invention, it is now possible to afford corrosion inhibition of metallic tubing as well as to provide means to dissolve salt in the production stream in the area below the packer assembly, as well as the casing and tubing inserted through the packer assembly. In this fashion, the complete internal and external diameters of the entire metallic tubing string are afforded exposure to the injected fluid by means of a complete corrosion protection circulation path.

SUMMARY OF THE INVENTION

Figure 1:
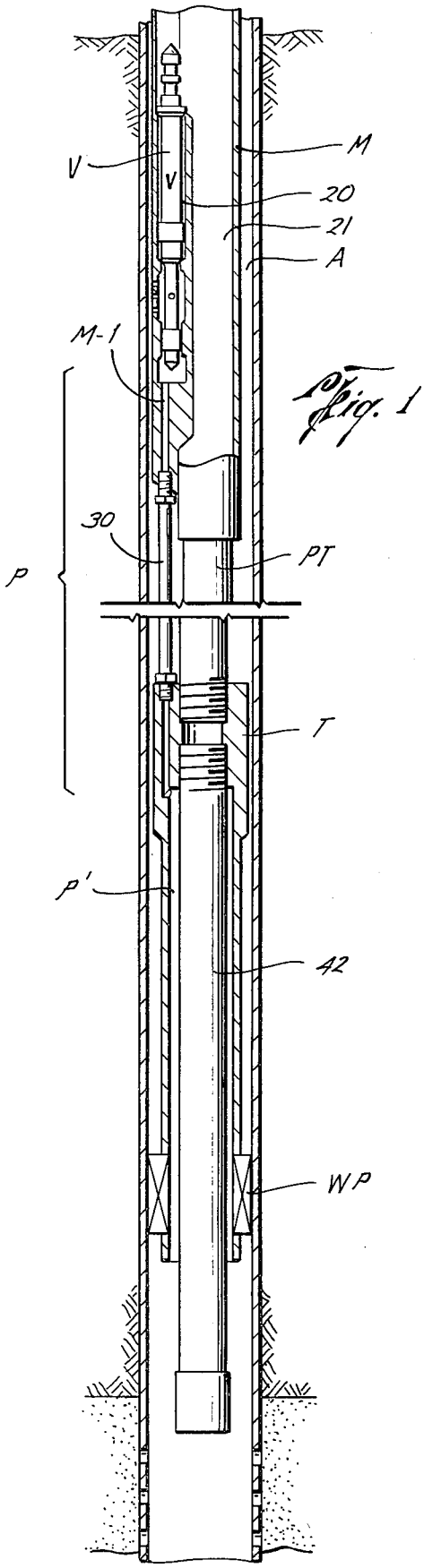
FIG. 1 is a longitudinally depicted schematic drawing of the apparatus of the present invention.

The present invention provides apparatus for affording transmission of inhibitor solution within and below the bore of a well packer during production of hydrocarbons in a subterranean well by use of a valve mechanism housed within a side pocket mandrel, the mandrel being carried with a parallel flow tube engaged with a packer therebelow.

DESCRIPTION OF THE PREFERRED EMBODIMENTS

The present invention utilizes a side pocket mandrel M for the receipt of a valve mechanism V for permitting fluid communication between the tubing-casing casing annulus A and a bypass passageway P immediate the lower end of the valve assembly V, a parallel flow tube T for receipt of the small diameter tubing 30 forming a part of the bypass passageway P, and production tubing P-T carrying the side pocket mandrel M, the parallel flow tube T being sealingly anchored within the bore of a well packer W-P.

The packer has a pliant, elastic packing 11 thereon for sealing against the inner wall of the well casing C, and also upper and lower slips 12 and 13 which are expandable into gripping engagement with the wall of the well casing C to anchor the packer thereto against movement in both upward and downward directions. Details of the specific well packer employed are not important to an understanding of this invention. Moreover, the particular design of the packing mechanism is not a particularly important aspect of this invention. The present invention is designed for use with any packing mechanism which will receive within its bore a flow tube mechanism and bypass passageway as described herein.

Upon setting of the packing mechanism, the running-in tubing string is disengaged from the upper end of the packing body 10 and removed to the top of the well. Thereafter, the side pocket mandrel M is affixed to the lower end of the production tubing with the parallel flow tube T being engaged to the lower end of the mandrel M, the nipple assembly N being threadedly engaged to the lower end of the parallel flow tube T.

The particular side pocket mandrel M utilized in conjunction with the present invention is not critical thereto, the size, construction and design of the mandrel M being somewhat variable within the scope of the present invention. Numerous mandrels M are known to those skilled in the art and are available commercially. The mandrel M provides a side pocket 20 longitudinally extending to one side of and separate from a main body 21 which forms a part of the production flow path extending from the zone Z through the production tubing P-T to the top of the well.

The lower end of the pocket 20 provides a bypass M-1 which communicates with the upper end of the bypass passageway P formed by means of engagement with the pocket 20 of a comparatively small diameter tubing 30 extending from the lower end of the pocket 20 to one side of the mandrel M and the production tubing P-T therebelow and received within the upper end of the parallel flow tube T. The lower end of the tubing 30 communicates with a longitudinally extending bypass line 41 formed within a central housing 40 of the parallel flow tube T, the bypass line 41, in turn, communicating with a longitudinally extending fluid passageway $P^1$ therebelow and encircling the production tubing 42 inserted within the parallel flow tube and through the bore of the packer apparatus W-P through the ejection portal $P_2$.

The parallel flow tube T has a central housing member 40 having threaded means 40A at its upper end for engagement with the lower end of the production tubint P-T. The central housing member 40 also has to one side thereof means for engaging the lower end of the bypass tubing 30, the bypass tubing 30 communicating with the bypass line 41 within the central housing 40 of the parallel tubing T, the line 41 terminating at its lower end or port 41A and meeting fluid passageway $p^1$. The central housing 40 also has inner and lower thread members 40B for engagement of a longitudinally extending tubular section 42 therebelow, the tubular section 42 extending within the bore of the well packer apparatus W-P therebelow and communicating with and forming a part of the production tubing P-T thereabove. Forming the extreme lower end and outer portion of the central housing 40 are threaded means 40C for engagement of external tubing member 43 which, in turn, is engaged at its lower end by thread members 43A to the nipple N. The annular area between the external tubing 43 and the tubular section 42 forms the fluid passageway $p^1$. The parallel flow tube T shown in the figures is of known construction and is shown in FIG. V-39, page 400 of the 1974-75 catalog of Baker Division, Baker Oil Tools, Inc.

Carried on the lower end of the external tubing 43 is the nipple assembly N which is engaged within the latch L carried on and above the packer assembly W-P, the nipple N carrying chevron seals S which engage the smooth inner bore of the packer W-P.

The chemical injector valve V provides means for selective insertion of the corrosion inhibitor within the annulus A for subsequent flow through the bypass passageways P and $P^1$. The valve apparatus V provides at is upper end a latch mechanism L for insertion and removal of the valve mechanism V from the side pocket mandrel M. The valve V basically is comprised of an outer housing 50 the upper end of which forms the exterior of the latch mechanism L, and the lower portion of which houses a circumferentially extending valve seat 51 for normal positioning of a valve head 52 thereabove. Within the housing 50 is an outwardly protruding lock 53 rotatably positioned on its receiving pin 53A. The lock 53 is rotatably positioned for lock engagement within companion groove 53B formed with the outer wall 20A of the pocket 20 within the mandrel M.

Figure 2A:
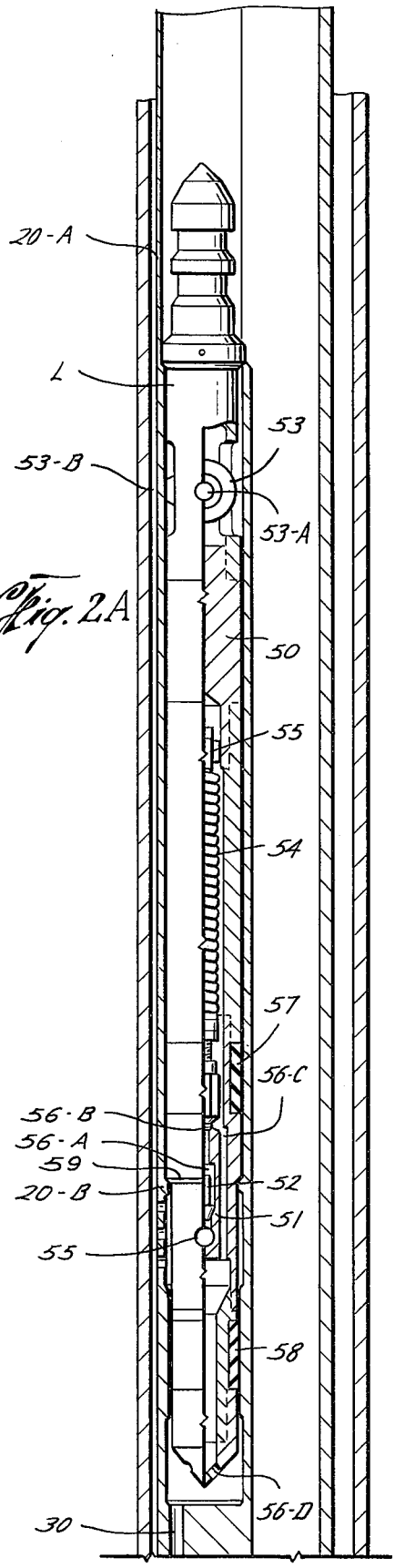
FIGS. 2A, 2B, and 2C together represent an enlarged longitudinal drawing of the apparatus of the present invention, FIG. 2B being a lower continuation of FIG. 2A, and FIG. 2C being a lower continuation of FIG. 2B.
Figure 2B:
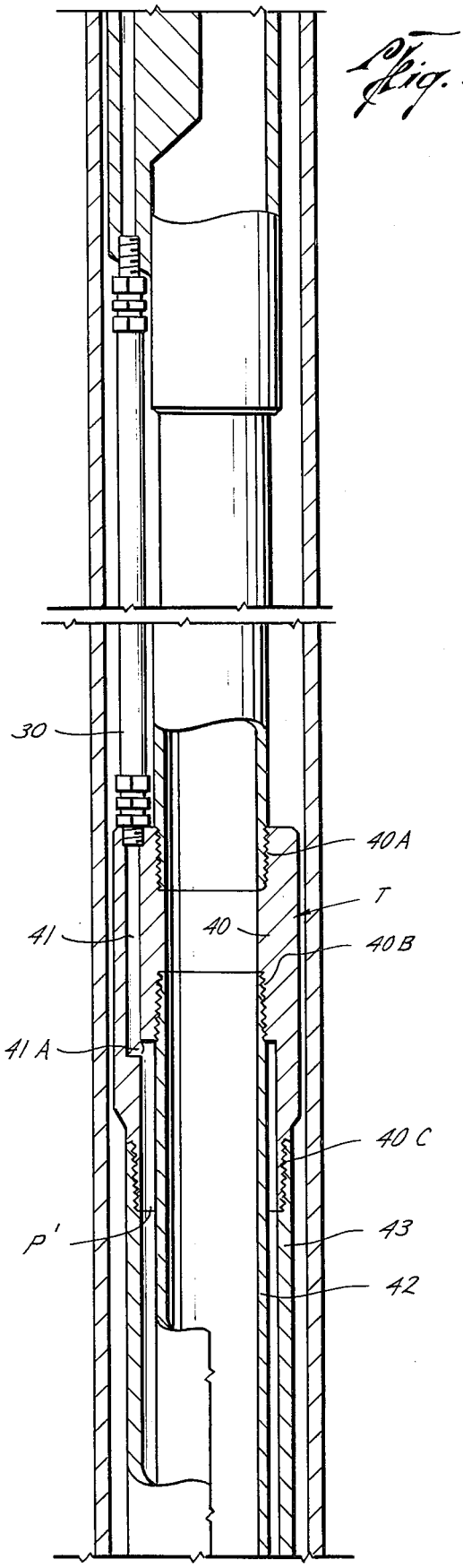
Figure 2C:
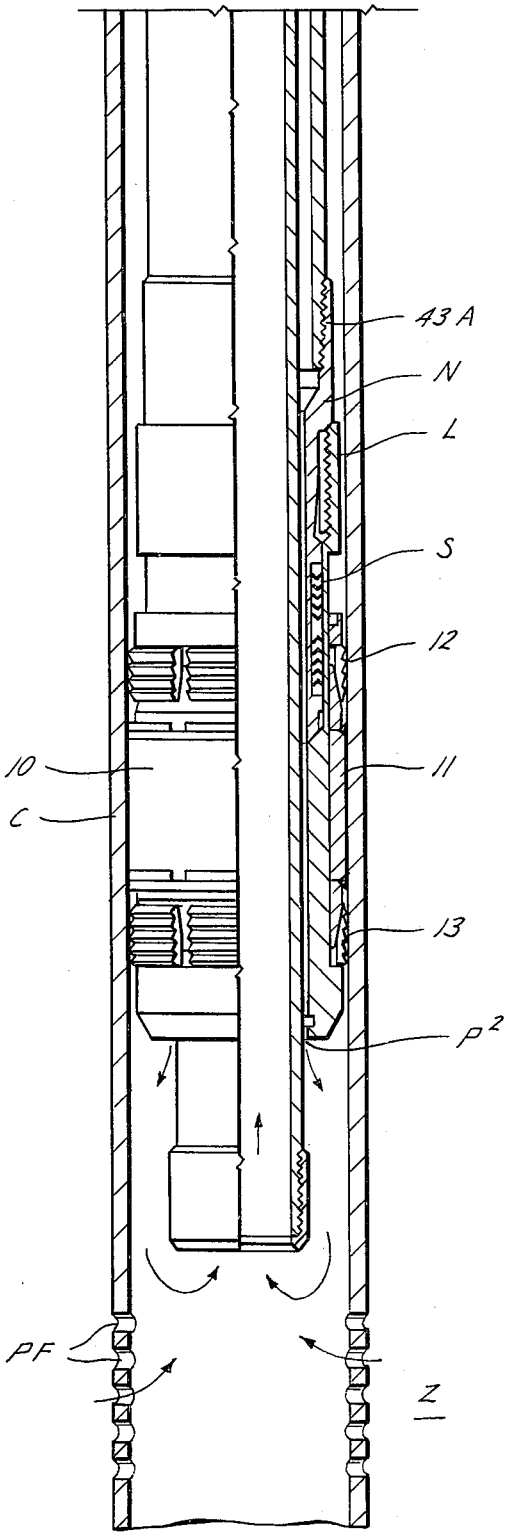

The valve mechanism V, shown in FIG. 2A is constructed such that a compressed spring element 54 exteriorally encircled about a longitudinally extending mandrel 55 therein is activated at a pre-selected differential pressure to cause the head 52 to be removed from the seat 51 to permit transmission of fluid within the annulus A above the valve mechanism V through a port 55 below the head 52, thence through a passageway within the valve mechanism V, through a portal 56B extending through the mandrel 55, thence exteriorally of the mandrel 55 through a longitudinally extending flow path 56C which terminates in a plurality of ejection ports 56D at the lowermost end of the valve mechanism V for fluid communication thereafter through the passage 30. The valve prevents fluid flow in a reverse direction.

The valve mechanism V also provides circularly and exteriorally extending upper and lower packer elements 57 and 58 for sealing against the interior of the wall 20A of the side pocket 20. These packing elements 57 and 58 prevent fluid communication from the annulus A through the valve mechanism V when the head 52 is sealingly engaged upon its companion seat 51.

The valve mechanism V, as shown, is spring loaded and is designed to operate at a pre-selected differential pressure between the pressure within the annulus A and the pressure within the production tubing P-T. Generally speaking, this differential pressure will be between 100 and 500 psi, but it is variable in accordance with the particular design of the selected valve mechanism. Thus, when the pressure in annulus A is increased to an amount between 100 and 500 psi over that pressure within the production tubing P-T, the increased pressure exerted upon the lower face of the head 52 will cause the spring 54 to compress sufficiently to permit the head 52 to separate from its seat 51, thus allowing fluid communication within the port 55 through the pathway through the valve, thence through tubing 30 and through the fluid passageway $P^1$ communicating therewith.

In the operation of the present invention, the packer W-P is lowered on a running-in string, which may be tubular or wire line, and is set by activating the slips 12 and 13 to cause the packing 11 on the body 10 to sealingly engage the interior of the casing C. Thereafter, the running-in string is removed from the packer apparatus W-P. At the top of the well, the side pocket mandrel M is made up in the production tubing string P-T together with the parallel flow tube T. The side tubing 30 is engaged at its respective side position at the end of the side pocket mandrel M and attached to the upper end of the central housing 40 of the parallel flow tube T. Additional production tubing P-T is engaged within the parallel flow tube T by threaded connection to the interior of the central housing 40. After final assembly, the production tubing P-T with the side pocket mandrel M, the tubing 30, and the parallel flow tube T (with additional production tubing P-T being engaged therewith) are inserted within the well through the casing C and the body 10 of the packer W-P until the nipple assembly N is companionally engaged within the latch L to lock the production tubing P-T onto the packer W-P and permit the chevron seals S to engage the smooth interior bore of the body 10 of the packer W-P.

Prior to production of hydrocarbons within the zone Z through the perforations PF to the top of the well, the valve assembly V is run on wire line with a landing assembly (not shown) and affixed within the pocket 20 of the mandrel M, with the lock 53 being engaged within its companion groove 53B along the wall 20A. The valve V then is in secured position as a result of the lock 53 being within the grooves 53B and the inwardly protruding shoulder 20B along the interior wall 20A of the side pocket mandrel M engaging its companion lock shoulder 59 circumferentially extending along the lower portion of the housing 50 of the valve V immediately below the packer 57. Accordingly, the apparatus now is in position for operation.

A solution containing the pre-selected corrosion inhibitor formulation is inserted in the well in the casing C for circulation within the annulus A. Upon reaching the pre-selected differential pressure (which is usually between 100 and 500 psi), the fluid carrying the corrosion inhibitor will pass through the port 55, the housing 50 of the valve V, urging the head 52 away from its companion seat 51 to provide a fluid passageway through the valve V, the fluid passageway being formed by the port 55, the communicating path 56A within the valve V, the portal 56B within the mandrel 55 of the valve V, the flow path 56C formed exteriorally of the mandrel 55, and the ejection ports 56D at the lowermost end of the valve V. The fluid then is circulated lowerly through the bypass passageway P which is formed by the bypass M-1 in the mandrel M which communicates with the ejection ports 56D, the tubing 30 therebelow, and by bypass line 41 formed along a longitudinal portion of the central housing 40 of the parallel flow tube T. The corrosion inhibitor solution enters lower fluid passageway $P^1$ below the parallel flow tube T exteriorally of tubular section 42 and interiorally of external tubing 43 by means of port 41A at the lowermost end of the bypass line 41. The solution carried within the fluid passageway $P^1$ is ejected through a lower portal $P^2$ immediate the lower end of the body 10 of the packer W-P and below the lower slips 13 on the packer W-P. The inhibitor solution then is transmitted with the hydrocarbons within the zone Z passing within the casing C through the perforations PF to the top of the well through the interior of the tubular section 42 and the production tubing P-T.

It can be seen from the above description that the present invention affords a means for enabling a solution containing a corrosion inhibitor to be exposed to the exterior and interior surfaces of production tubing P-T represented by tubular section 42, as well as to the metallic walls defining the bore of the packer W-P.

Although the invention has been described in terms of specified embodiments which are set forth in detail, it should be understood that this is by way of illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for use in a subterranean well to inject inhibitor solution within and below the bore of a well packer mechanism and thereafter circulate said solution with produced hydrocarbons through and to the top of said well, comprising: valving means for selective transmission of said inhibitor solution within said well through said apparatus; mandrel means for receipt of said valving means; by-pass means in communication with said valving means for carrying said inhibitor solution therethrough; tubular means having first and second tubing, said first tubing defining a flow path in communication with said by-pass means for carrying said inhibitor solution, and said second tubing defining a flow path for fluid transmission to the top of the well; and well packer means for receipt of said first and second tubing, said packer means defining therein a flow path communicating with the flow path defined within said first tubing whereby said inhibitor solution is exposed to and circulated within the flow path in said packer means and in communication with the flow path defined in said second tubing.

2. Apparatus for use in a subterranean well to inject inhibitor solution within and below the bore of a well packer mechanism and thereafter circulate said solution with produced hydrocarbons through and to the top of said well, comprising: pressure activated valving means for selective transmission of said inhibitor solution within said well through said apparatus; mandrel means defining a side pocket for receipt of said valving means; by-pass means in communication with said valving means for carrying said inhibitor solution therethrough; parallel tubular means having outer and inner tubing, said outer tubing defining a flow path in communication with said by-pass means for carrying said inhibitor solution, and said inner tubing defining a flow path for fluid transmission to the top of the well; and well packer means for receipt of said inner and outer tubing, said packer means defining therein a flow path communicating with the flow path defined within said outer tubing whereby said inhibitor solution is exposed to and circulated within the flow path in said packer means and in communication with the flow path defined in said inner tubing.

3. Apparatus for use in a subterranean well to inject inhibitor solution within and below the bore of a well packer means defining therewith a flow path, and thereafter circulate said solution with produced hydrocarbons through and to the top of said well, comprising: pressure activated valving means for selective transmission of said inhibitor solution within said well through said apparatus; mandrel means defining a side pocket for receipt of said valving means; by-pass means in communication with said valving means for carrying said inhibitor solution therethrough, and parallel tubular means having outer and inner tubing, said outer tubing defining a flow path in communication with said by-pass means for carrying said inhibitor solution, and said inner tubing defining a flow path for fluid transmission to the top of the well, the flow path within said packer means being in communication with the flow path defined within said outer tubing whereby said inhibitor solution is exposed to and circulated within the flow path in said packer means and in communication with the flow path defined in said inner tubing.

4. Apparatus for use in a subterranean well to inject inhibitor solution within and below the bore of a well packer mechanism and thereafter circulate said solution with produced hydrocarbons through and to the top of said well, comprising: mandrel means defining a side pocket for receipt of valving means for selective transmission of said inhibitor solution within said well through said apparatus; by-pass means in communication with said mandrel means for carrying said inhibitor solution therethrough; parallel tubular means having outer and inner tubing, said outer tubing defining a flow path in communication with said by-pass means for carrying said inhibitor solution, said inner tubing defining a flow path for fluid transmission to the top of the well; and well packer means for receipt of said inner and outer tubing, said packer means defining therein a flow path communicating with the flow path defined within said outer tubing whereby said inhibitor solution is exposed to and circulated within the flow path in said packer means and in communication with the flow path defined in said inner tubing.

5. Apparatus for use in a subterranean well to inject inhibitor solution within and below the bore of a well packer means having a defined therewithin a flow path, and thereafter circulate said solution with produced hydrocarbons through and to the top of said well, comprising: mandrel means defining a side pocket for receipt of valving means for selective transmission of said inhibitor solution within said well through said apparatus; by-pass means in communication with said valving means for carrying said inhibitor solution therethrough; and parallel tubular means having outer and inner tubing, said outer tubing defining a flow path in communication with said by-pass means for carrying said inhibitor solution, said inner tubing defining a flow path for fluid transmission to the top of the well, the flow path defined within said packer means being in communication with the flow path defined within said outer tubing whereby said inhibitor solution is exposed to and circulated within the flow path in said packer means and in communication with the flow defined in said inner tubing.

6. Apparatus for use in subterranean well to inject inhibitor solution within and below the bore of a well packer mechanism and thereafter circulate said solution with produced hydrocarbons through and to the top of said well, comprising: differential pressure activated valving means for selective transmission of said inhibitor solution within said well through said apparatus; mandrel means defining a side pocket for receipt of said valving means; by-pass means in communication with said valving means for carrying said inhibitor solution therethrough; parallel tubular means having outer and inner tubing, said outer tubing defining a flow path in communication with said by-pass means for carrying said inhibitor solution, and said inner tubing defining a flow path for fluid transmission to the top of the well; and well packer means for receipt of said inner and outer tubing, said packer means defining therein a flow path communicating with the flow path defined within said outer tubing whereby said inhibitor solution is exposed to and circulated within the flow path in said packer means and in communication with the flow path defined in said inner tubing.

7. Apparatus for use in a subterranean well to inject inhibitor solution within and below the bore of a well packer defining therewith a flow path, and thereafter circulate said solution with produced hydrocarbons through and to the top of said well, comprising: differential pressure activated valving means for selective transmission of said inhibitor solution within said well through said apparatus; mandrel means defining a side pocket for receipt of said valving means; by-pass means in communication with said valving means for carrying said inhibitor solution therethrough; and parallel tubular means having outer and inner tubing, said outer tubing defining a flow path in communication with said by-pass means for carrying said inhibitor solution, and inner tubing defining a flow path for fluid transmission to the top of the well, the flow path defined within said packer means being in communication with the flow path defined within said outer tubing whereby said inhibitor solution is exposed to and circulated within the flow path in said packer means and in communication with the flow path defined in said inner tubing.

8. Apparatus for use in a subterranean well to inject a fluid medium within and below the bore of a well packer mechanism and thereafter circulate said fluid medium with produced hydrocarbons through and to the top of said well, comprising: valving means for selective transmission of said fluid medium within said well through said apparatus; mandrel means for receipt of said valving means; by-pass means in communication with said valving means for carrying said fluid medium therethrough; tubular means having first and second tubing, said first tubing defining a flow path in communication with said by-pass means for carrying said fluid medium, and said second tubing defining a flow path for fluid transmission to the top of the well; and well packer means for receipt of said first and second tubing, said packer means defining therein a flow path communication with the flow path defined within said first tubing whereby said fluid medium is exposed to and circulated within the flow path in said packer means and in communication with the flow path defined in said second tubing.

9. Apparatus for use in a subterranean well to inject a fluid medium within and below the bore of a well packer mechanism and thereafter circulate said fluid medium with produced hydrocarbons through and to the top of said well, comprising: pressure activated valving means for selective transmission of said fluid medium within said well through said apparatus; mandrel means defining a side pocket for receipt of said valving means; by-pass means in communication with said valving means for carrying said fluid medium therethrough; parallel tubing means having outer and inner tubing, said outer tubing defining a flow path in communication with said by-pass means for carrying said fluid medium, and said inner tubing defining a flow path for fluid transmission to the top of the well; and well packer means for receipt of said inner and outer tubing, said packer means defining therein a flow path communicating with the flow path defined within said outer tubing whereby said fluid medium is exposed to and circulated within the flow path in said packer means and in communication with the flow path defined in said inner tubing.

10. Apparatus for use in subterranean well to inject a fluid medium within and below the bore of a well packer defining therewithin a flow path, and thereafter circulate said fluid medium with produced hydrocarbons through and to the top of said well, comprising: pressure activated valving means for selective transmission of said fluid medium within said well through said apparatus; mandrel means defining a side pocket for receipt of said valving means; by-pass means in communication with said valving means for carrying said fluid medium therethrough, and parallel tubular means having outer and inner tubing, said outer tubing defining a flow path in communication with said by-pass means for carrying said fluid medium, said inner tubing defining a flow path for fluid transmission to the top of the well, the flow path defined within said packer communicating with the flow path defined within said outer tubing whereby said fluid medium is exposed to and circulated within the flow path in said packer and in communication with the flow path defined in said inner tubing.

11. Apparatus for use in a subterranean well to inject a fluid medium within and below the bore of a well packer mechanism and thereafter circulate said fluid medium with produced hydrocarbons through and to the top of said well, comprising: mandrel means defining a side pocket for receipt of valving means for selective transmission of said fluid medium within said well through said apparatus; by-pass means in communication with said mandrel means for carrying said fluid medium therethrough; parallel tubular means having outer and inner tubing, said outer tubing defining a flow path in communication with said by-pass means for carrying said fluid medium, said inner tubing defining a flow path for fluid transmission to the top of the well; and well packer means for receipt of said inner and outer tubing, said packer means defining therein a flow path communicating with the flow path defined within said outer tubing whereby said fluid medium is exposed to and circulated within the flow path in said packer means and in communication with the flow path defined in said inner tubing.

12. Apparatus for use in a subterranean well to inject a fluid medium within and below the bore of a well packer means, said packer means having defined therein a flow path, and thereafter circulate said fluid medium with produced hydrocarbons through and to the top of said well, comprising: mandrel means defining a side pocket for receipt of valving means for selective transmission of said fluid medium within said well through said apparatus; by-pass means in communication with said valving means for carrying said fluid medium therethrough; parallel tubular means having outer and inner tubing, said outer tubing defining a flow path in communication with said by-pass means for carrying said fluid medium, said inner tubing defining a flow path for fluid transmission to the top of the well, said flow path defined within said packer means communicating with the flow path defined within said outer tubing whereby said fluid medium is exposed to and circulated within the flow path in said packer means and in communication with the flow path defined in said inner tubing.

13. Apparatus for use in a subterranean well to inject a fluid medium within and below the bore of a well packer mechanism and thereafter circulate said fluid medium with produced hydrocarbons through and to the top of said well, comprising: differential pressure activated valving means for selective transmission of said fluid medium within said well through said apparatus; mandrel means defining a side pocket for receipt of said valving means; bypass means in communication with said valving means for carrying said fluid medium therethrough; parallel tubular means having outer and inner tubing, said outer tubing defining a flow path in communication with said by-pass means for carrying said fluid medium, and said inner tubing defining a flow path for fluid transmission to the top of the well; and well packer means for receipt of said inner and outer tubing, said packer means defining therein a flow path communicating with the flow path defined within said outer tubing whereby said fluid medium is exposed to and circulated within the flow path in said packer means and in communication with the flow path defined in said inner tubing.

14. Apparatus for use in a subterranean well to inject a fluid medium within and below the bore of a well packer means, said packer means having defined therewithin a flow path, and thereafter circulate said fluid medium with produced hydrocarbons through and to the top of said well, comprising: differential pressure activated valving means for selective transmission of said fluid medium within said well through said apparatus; mandrel means defining a side pocket for receipt of said valving means; by-pass means in communication with said valving means for carrying said fluid medium therethrough; parallel tubular means having outer and inner tubing, said outer tubing defining a flow path in communication with said by-pass means for carrying said fluid medium, and said inner tubing defining a flow path for fluid transmission to the top of the well, the flow path defined within said packer means communicating with the flow path defined within said outer tubing whereby said fluid medium is exposed to and circulated within the flow path in said packer means and in communication with the flow path defined in said inner tubing.

* * * * *